US007854021B2

(12) United States Patent
Compton et al.

(10) Patent No.: US 7,854,021 B2
(45) Date of Patent: Dec. 21, 2010

(54) ATTACHABLE AND DETACHABLE POCKET COVER

(75) Inventors: Joyce Brenda Compton, Aldie, VA (US); Jill Brenda Compton, Aldie, VA (US)

(73) Assignee: J. Bren & Company, Inc., Manassas, VA (US)

( * ) Notice: Subject to any disclaimer, the term of this patent is extended or adjusted under 35 U.S.C. 154(b) by 3 days.

(21) Appl. No.: 11/892,228

(22) Filed: Aug. 21, 2007

(65) Prior Publication Data

US 2009/0049719 A1 Feb. 26, 2009

(51) Int. Cl.
*A41D 27/12* (2006.01)
*A41D 27/00* (2006.01)
*A41D 27/20* (2006.01)

(52) U.S. Cl. ..... 2/249; 2/243.1; 2/247; 2/250; 2/252; 24/3.1; 24/3.5

(58) Field of Classification Search ..... 2/244–254, 2/279, 69, 115, 243.1; 24/3.1, 3.5, 10 R; 40/1.5, 299.01, 315, 642.02, 661, 661.01, 40/584, 606.01, 611.01, 611.06, 611.09, 40/611.1; 206/37–39.8; 224/101, 191, 230
See application file for complete search history.

(56) References Cited

U.S. PATENT DOCUMENTS

| | | | | | |
|---|---|---|---|---|---|
| 721,359 | A | * | 2/1903 | Dexter | 2/252 |
| RE14,989 | E | | 11/1920 | Spalding | |
| 1,827,466 | A | * | 10/1931 | Gilbert | 206/37 |
| 2,020,979 | A | * | 11/1935 | Wiedermann | 2/247 |
| 2,163,710 | A | | 6/1939 | Schockling | |
| 2,285,670 | A | * | 6/1942 | Logsdon | 24/3.5 |
| 2,415,132 | A | * | 2/1947 | Greer | 2/249 |
| 2,417,786 | A | * | 3/1947 | Smith | 2/250 |
| 2,425,540 | A | | 8/1947 | Kaplan | |
| 2,472,344 | A | * | 6/1949 | Rosenbarger | 206/37 |
| 2,511,242 | A | | 6/1950 | Brown | |
| 2,513,884 | A | | 7/1950 | Maurer | |
| 2,523,804 | A | * | 9/1950 | Albro | 2/250 |
| 2,530,453 | A | * | 11/1950 | Eagle | 2/247 |
| 2,544,750 | A | | 3/1951 | D'Alesio | |
| 2,586,584 | A | * | 2/1952 | Wagner | 206/37 |
| 2,606,587 | A | * | 8/1952 | Porter | 2/252 |
| 2,644,991 | A | * | 7/1953 | Albro | 241/10 R |
| 2,697,838 | A | | 12/1954 | Bove et al. | |

(Continued)

OTHER PUBLICATIONS

International Search Report in Application No. PCT/US2007/018470, dated Jun. 26, 2008.

(Continued)

*Primary Examiner*—Bernarr E Gregory
(74) *Attorney, Agent, or Firm*—Finnegan, Henderson, Farabow, Garrett & Dunner, L.L.P.

(57) ABSTRACT

An attachable and detachable cover for a pocket having an inner area. The cover may include a first portion disposed external to the pocket, generally conforming to a contour of the pocket, and removably secured to the pocket. The first portion may include a decorative element. In addition, the decorative cover may include a second portion disposed within the inner area of the pocket. The second portion may cause the cover to be retained by the pocket. Further, the cover may include a third portion connecting the first portion and the second portion.

21 Claims, 8 Drawing Sheets

U.S. PATENT DOCUMENTS

| | | | | | |
|---|---|---|---|---|---|
| 2,746,058 | A | * | 5/1956 | Greer | 2/249 |
| 3,026,532 | A | | 3/1962 | Janz | |
| 3,178,784 | A | * | 4/1965 | Krauthamer | 24/10 R |
| 3,280,488 | A | | 10/1966 | Rubin | |
| 3,295,235 | A | * | 1/1967 | Tauber | 40/1.5 |
| 3,320,620 | A | * | 5/1967 | Weidler et al. | 2/250 |
| 3,371,829 | A | | 3/1968 | Phillips | |
| 3,466,779 | A | | 9/1969 | Zucker et al. | |
| 3,611,444 | A | | 10/1971 | Rector | |
| 3,619,817 | A | * | 11/1971 | Rockwell | 2/250 |
| 3,647,056 | A | * | 3/1972 | Jacobson et al. | 206/38 |
| 3,704,470 | A | | 12/1972 | Beno et al. | |
| 3,723,994 | A | * | 4/1973 | Tucker | 2/248 |
| 3,741,376 | A | * | 6/1973 | Brown et al. | 206/37 |
| 3,786,520 | A | | 1/1974 | Harmon | |
| 3,797,717 | A | * | 3/1974 | Collins | 224/230 |
| 3,840,901 | A | | 10/1974 | Eyster | |
| 3,931,688 | A | | 1/1976 | Owens | |
| 4,083,446 | A | | 4/1978 | Schuchman, Sr. | |
| 4,236,331 | A | | 12/1980 | Mattson | |
| 4,266,300 | A | | 5/1981 | Partridge | |
| 4,310,109 | A | * | 1/1982 | Coyle | 224/230 |
| 4,365,355 | A | | 12/1982 | Off et al. | |
| 4,513,454 | A | * | 4/1985 | Anderson et al. | 2/246 |
| 4,602,390 | A | | 7/1986 | Morera et al. | |
| 4,650,069 | A | * | 3/1987 | Linton | 206/37 |
| 4,656,673 | A | | 4/1987 | Easton et al. | |
| 4,875,237 | A | * | 10/1989 | Cohen | 2/247 |
| 4,924,613 | A | | 5/1990 | Levin | |
| 4,937,963 | A | * | 7/1990 | Barnes | 40/661 |
| 4,975,987 | A | | 12/1990 | Teachout et al. | |
| 5,054,127 | A | | 10/1991 | Zevchak | |
| 5,086,516 | A | | 2/1992 | Baxter et al. | |
| 5,231,702 | A | | 8/1993 | Masters | |
| 5,468,152 | A | | 11/1995 | Lenart | |
| 5,504,976 | A | | 4/1996 | Reeves | |
| 5,737,775 | A | | 4/1998 | Schwartz | |
| 5,809,576 | A | | 9/1998 | Huston et al. | |
| 5,815,845 | A | * | 10/1998 | Ault et al. | 2/249 |
| 6,035,449 | A | | 3/2000 | Galler et al. | |
| 6,339,866 | B1 | | 1/2002 | French | |
| 6,353,984 | B1 | | 3/2002 | Wilson | |
| 6,397,398 | B1 | | 6/2002 | Herder | |
| 6,684,544 | B1 | * | 2/2004 | Buettell | 40/661.01 |
| 6,691,323 | B2 | | 2/2004 | Widmer | |
| 6,839,993 | B1 | | 1/2005 | Piché | |
| 7,003,810 | B2 | | 2/2006 | Goldkind | |
| 2007/0107287 | A1 | * | 5/2007 | Huang | 40/611.1 |

OTHER PUBLICATIONS

Written Opinion of the International Searching Authority in Application No. PCT/US2007/018470, dated Jun. 26, 2008.

* cited by examiner

ATTACHABLE AND DETACHABLE POCKET COVER

TECHNICAL FIELD

The present disclosure relates generally to covers for pockets, and more particularly, to an attachable and detachable pocket cover.

BACKGROUND

Articles of clothing, such as, for example, pants, jeans, shorts, shirts, etc., commonly include one or more pockets. While the pockets may have some inherent decorative features due to stitching, shape, and the like, the pockets may not have a means for accessorizing the pocket by detachably connecting an element to the outside of the pocket. Further, the pockets may not be capable of modification and personalization. Thus, the pockets may not offer a way to selectively and interchangeably display advertising, personal ornamentation, accessories, or communication, and may not function as a decorative carrier. The disclosed embodiments are directed to overcoming one or more of the problems set forth above.

SUMMARY

In one aspect, the present disclosure is directed to an attachable and detachable cover for a pocket having an inner area. The cover may include a first portion disposed external to the pocket, generally conforming to a contour of the pocket, and removably secured to the pocket. The first portion may include a decorative element. In addition, the cover may include a second portion disposed within the inner area of the pocket. The second portion may cause the cover to be retained by the pocket. Further, the cover may include a third portion connecting the first portion and the second portion.

In another aspect, the present disclosure is directed to an attachable and detachable cover for a pocket having an inner area. The cover may include a first portion disposed external to the pocket, generally conforming to a contour of the pocket, and removably secured to the pocket. The first portion may be reversible and may include one or more first layers of material. In addition, the cover may include a second portion disposed within the inner area. The second portion may include one or more layers of flexible material, and at least one layer of the one or more second layers may cause the first portion to retain a position proximally disposed to an external surface of the pocket.

In another aspect, the present disclosure is directed to an attachable and detachable cover for a pocket having an inner area. The cover may include a first portion disposed external to the pocket, generally conforming to a contour of the pocket, and removably secured to the pocket. The first portion may include an advertisement. In addition, the cover may include a second portion disposed within the inner area of the pocket. The second portion may cause the cover to be retained by the pocket. In addition, the cover may include a third portion connecting the first portion and the second portion. Further, the third portion may bridge a top of the pocket.

DETAILED DESCRIPTION

Figure 1B:
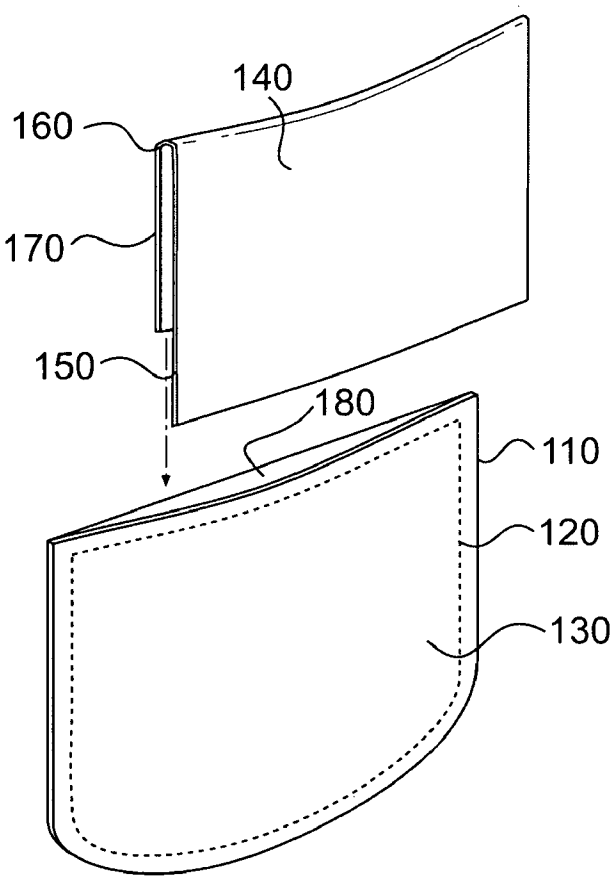
FIG. 1*b* is a perspective view of a pocket having an attachable and detachable cover, consistent with certain disclosed embodiments.
Figure 1A:
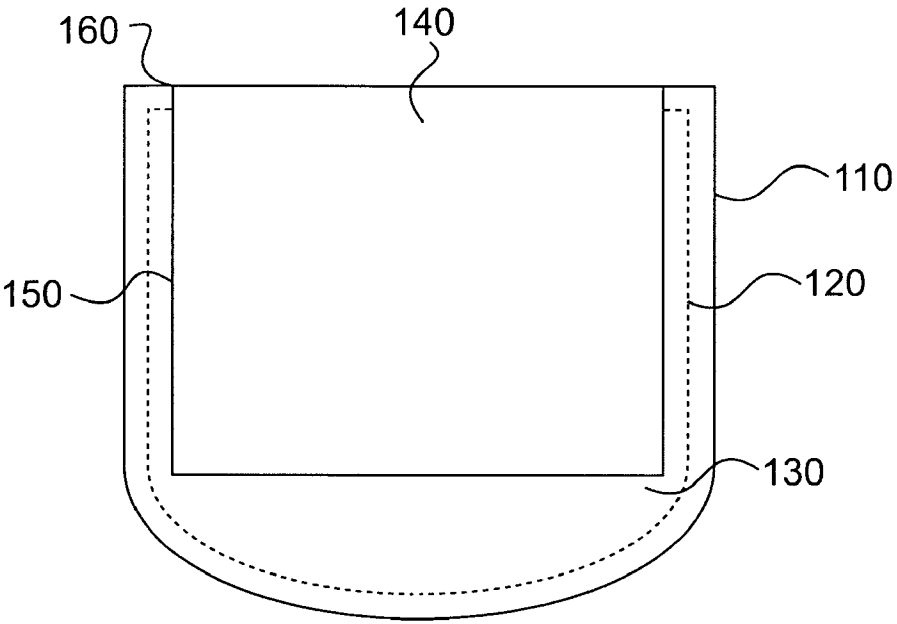
FIG. 1*a* is a front view of a pocket having an attachable and detachable cover, consistent with certain disclosed embodiments.

FIG. 1*a* illustrates a front view of a pocket 110 having an attachable and detachable cover 140, and FIG. 1*b* illustrates a perspective view of pocket 110 and cover 140. As shown in FIGS. 1*a* and 1*b*, pocket 110 may include seam 120 and pocket face 130. Seam 120 may extend across the perimeter of pocket 110. Seam 120 may be used to attach pocket 110 to a garment, such as a shirt, or an accessory, such as a purse. Seam 120 may be used to prevent fraying of the pocket fabric, and/or may be used for decorative purposes. Seam 120 may be visible, invisible, or any combination thereof. Pocket 110 may also have an external surface or pocket face 130. In addition, as shown in FIG. 1*b*, pocket 110 may also include inner area 180.

Pocket 110 may be any type of pocket. In one exemplary embodiment, pocket 110 may be found in any type of garment for the lower body, such as, for example, pants, trousers, jeans, slacks, shorts, skirt, skorts, culottes, and the like. In another embodiment, pocket 110 may be found in any type of garment for the upper body, such as, for example, shirts, blouses, jackets, coats, blazers, smocks, aprons, and the like. As another embodiment, pocket 110 may be found in any type of garment for the whole body, such as, for example, a dress, a leotard, a jogging suit, etc. In a further embodiment, pocket 110 may be found in any type of accessory, such as, for example, hats, backpacks, umbrellas, ties, luggage, purses, bags, briefcases, computer carriers, etc. Pocket 110 may also be found in other items, such as, for example, shoes, boots, party supplies, etc. Pocket 110 may be of any shape, size, or construction, as is known in the art.

Cover 140 may be used as a decorative element of pocket 110, and may extend across a portion or the entire area of pocket face 130. In one exemplary embodiment, one or more layers of materials may be used to create decorative features of cover 140. The one or more layers of material may be used to variously provide ornamentation, structure, shape, flexibility, sturdiness, connection, etc. The one or more layers of material may be used selectively and intermittently such that not every layer of material may extend across the entire area of cover 140. In one exemplary embodiment, all of the one or more layers of material may extend across a portion less than the entire area of cover 140.

The one or more layers of material may include, for example, backing materials, facing materials, finishing materials, embellishment materials, connection mechanisms, etc. Backing materials, facing materials, finishing materials, and embellishment materials may include, for example, natural and/or synthetic fabrics (e.g., leather, felt, faux fur, real fur, cotton, wool, jacquard, nylon, silk, quilted, toile, tulle, netted, gauze, stretchable, spandex, velvet, mesh, etc.), flowers (e.g., silk flowers, plastic flowers, papers flowers, fabric flowers, dried flowers, etc.), sound devices (e.g., piezoelectric devices, music, noisemakers, etc.), scents (e.g., perfumes, scratch-n-sniff, infused scents, etc.), wires and string (e.g., wires, rope, twine, string, etc.), including magnetized and/or non-magnetized metallic wires and string (e.g., gold, silver, aluminum, nickel, etc.), beads (e.g., glass, plastic, pearls, semi-precious stones, precious stones, bone, wood, metal, etc.), crystals, rhinestones, sequins, embroidery, paints (e.g., fabric paint, puff paint, glitter paint, etc.), inks (e.g., permanent, semi-permanent, temporary, etc.), chalkboard/chalk materials, buttons, screen print, mechanical/electrical (e.g., batteries and battery operated devices, LEDs, light tape, light wire, devices with moving parts, etc.), notions, ribbons and rick-rack, papers (e.g., raffia, twistie-paper, tissue, etc.), rubber, man-made and/or plastic materials (e.g., MYLAR™, latex, glassine, neoprene, plexiglass, etc.), fluids (e.g., gels, liquids, gases, etc., including, for example, silicon, water, oil, air), pictures, frames/photo holders, yarns, stamps and stamped designs, wood, chain and variations thereof (e.g., any style of chain including, for example, metal, paper, wood, etc.), glitter, stick-on, plastic eyes, elastic, watches/clocks, charms, lace, shoelaces (including straight, curly, stretchy, etc.), lock & key, key rings, binder rings, mirror, conditionally-activated accessories (i.e., movement activated, sound activated, etc.), adhesives, glues, stitch-witch, magnets, hook-and-loop tape (e.g., VELCRO™), etc.

Connection mechanisms may include one or more mechanisms and/or materials by which cover 140 may be retained in proximity to pocket 110. For example, connection mechanisms may include clips, pins, zippers, buttons, hooks (e.g., I-hooks, lobster clasp, etc.), snaps, magnets, hook-and-loop tape (e.g., VELCRO™), adhesive materials (e.g., glue, tape, etc.), comb-like attachment, clips and clasps (e.g., alligator clips, snap clips, jaw clasps, "belt hooks", D-rings, etc.), grommets and eyelets, etc.

In one exemplary embodiment, one or more connection mechanisms may be integrated into the design of cover 140. For example, buttons and snaps may be visible and thus may be integrated into the decorative elements of cover 140. In another exemplary embodiment, one or more connection mechanisms may be hidden by the decorative elements of cover 140. For example, one or more magnets or magnetized materials may be covered by one or more other layers of materials, and thus may not be readily visible. It is also contemplated that some connection mechanism for cover 140 may be hidden while other connection mechanisms for that same cover 140 may be readily visible. For example, a receiving portion of a snap may be visible while the projecting portion of a snap may be hidden by one or more layers of material and/or decorative elements.

In addition, one or more properties associated with the material and/or added design features may also be used to retain cover 140 in proximity to pocket 110. For example, surface resistance associated with one or more materials may be used to frictionally retain cover 140. Cover 140 may be frictionally retained using any of the embodiments shown and/or discussed herein. For example, one or more magnets and/or magnetized materials may be used to frictionally cover 140. In addition, one or more pieces of hook-and-loop tape may be used to frictionally retain cover 140. Further, buttons, clasps, clips, etc. may also be used to frictionally retain cover 140. In another embodiment, the weight of cover 140 may be used to gravitationally retain cover 140. Design features may include, for example, a design feature that catches at the inside seam of pocket 110, and the like.

As shown in FIGS. 1*a* and 1*b*, cover 140 may include three portions: an exterior portion 150, a bridging portion 160, and an interior portion 170. Each of exterior portion 150, bridging portion 160, and interior portion 170 may include one or more layers of material such as those described above.

Exterior portion 150 may extend across a portion or the entire area of pocket face 130, and may be proximally disposed to pocket face 130. Exterior portion 150 may include one or more decorative elements, features, advertisements, and/or other communication, using, for example, backing materials, facing materials, finishing materials, embellishment materials, connection mechanisms, etc. In one exemplary embodiment, exterior portion 150 may generally conform to the projective contour of pocket 110. For example, when a garment to which pocket 110 is attached is worn, pocket 110 may assume a shape according to the contours of the wearer. When this occurs, cover 140 may also follow the contours of the shape assumed by pocket 110, thereby allowing cover 140 to maintain its proximity to pocket face 130. In one exemplary embodiment, exterior portion 150 may be reversible. That is, both faces of exterior portion 150 may have decorative features, and may be interchangeably displayed by changing the externally facing direction of exterior portion 150, i.e., by turning over exterior portion 150.

As shown in FIG. 1*b*, interior portion 170 may be inserted into inner area 180 of pocket 110. Interior portion 170 may be used to retain cover 140 in proximity with pocket face 130. In one exemplary embodiment, interior portion 170 may be used to frictionally retain cover 140 in proximity with pocket face 130. For example, interior portion 170 may extend into the inner area 180 of pocket 110, and the surface resistance of the interior portion 170 against the surface resistance of inner area 180 may serve to retain cover 140 in proximity with pocket face 130.

Additionally and/or alternatively, interior portion 170 may include one or more materials by which cover 140 may be retained. For example, interior portion 170 may include one or more magnets or metallic material that, when used in connection with one or more other magnets or metallic material associated with exterior portion 150, may cause cover 140 to remain proximally disposed to pocket face 130. In one exemplary embodiment, pocket 110 may be situated between exterior portion 150 and interior portion 170.

In addition, interior portion 170 may generally conform to the shape contours of pocket 110. For example, as a garment is worn and changes shape in relation to the garment wearer, interior portion 170 may generally conform to the shape of inner area 180 of pocket 110. Thus, in some embodiments, the number and thickness of the layers of interior portion 170 may be determined based on its ability to comfortably remain in inner area 180, without deforming the pocket shape or causing discomfort to the garment wearer. Consideration may also be given to the affect that a bulk of material in pocket 110 may have on the appearance of the garment wearer. For example, it may be undesirable for a garment wearer to have greater bulk in a rear lower-body pocket; whereas, it may be very desirable for a garment wearer to have greater bulk in a breast pocket and the like.

In one exemplary embodiment, interior portion 170 may be reversible and/or interchangeable with external portion 150. That is, one or both faces of interior portion 170 may have decorative features, and may be interchangeably displayed by positioning interior portion 170 externally to pocket 110, and inserting exterior portion 150 into inner area 180 of pocket 110. In addition, an externally-positioned interior portion 170 may also be reversed by changing the externally facing direction of the externally-positioned interior portion 170, i.e., by turning over interior portion 170.

As shown in FIGS. 1*a* and 1*b*, bridging portion 160 may provide a connection between exterior portion 150 and interior portion 170. In some embodiments, bridging portion 160 may extend a small distance into inner area 180 of pocket 110 as well as extending over a small area of pocket face 130. Bridging portion 160 may be rigid, flexible, elastic, inelastic, or any combination thereof.

Bridging portion 160 may share one or more layers of materials with exterior portion 150 and/or interior portion 170. For example, exterior portion 150, bridging portion 160, and interior portion 170 may share a common layer of fabric, a common layer of adhesive, and an additional common layer of fabric.

Alternatively, bridging portion 160 may include different materials than that of exterior portion 150 and/or interior portion 170. For example, exterior portion 150 may include a first fabric layer, a first adhesive layer, a metallic layer, a second adhesive layer, and a second fabric layer; bridging portion 160 may include a single plastic layer; and interior portion 170 may include a first fabric layer, a first adhesive layer, a magnetic layer, a second adhesive layer, and a second fabric layer. Interior portion 170, bridging portion 160, and exterior portion 150 may be attached to one another using, for example, any one or more of backing materials, facing materials, finishing materials, embellishment materials, connection mechanisms, etc.

In some embodiments, exterior portion 150, bridging portion 160, and interior portion 170 may share at least one layer of material. For example, a sheath of fabric may extend the entire surface area of exterior portion 150, bridging portion 160, and interior portion 170. As another example, a base layer or an inner layer may be provided that extends from exterior portion 150, through bridging portion 160, to interior portion 170. For example, interior portion 170 may include a layer of fabric extending through bridging portion 160, to exterior portion 150. Layered onto the fabric layer, interior portion 170 may have an adhesive layer and a magnet layer. Layered onto the fabric layer, exterior portion 150 may have an adhesive layer, a chalkboard layer, and a layer of chalk (e.g., chalk writing on the chalkboard).

As another example, interior portion 170 may include a first layer of material extending through bridging portion 160, to exterior portion 150. Layered onto the first layer of material, interior portion 170 may have an adhesive layer and a magnet layer. Layered onto the fabric layer, exterior portion 150 may have an adhesive layer, a metallic layer, a fluid layer including one or more decorative elements (e.g., a liquid with one or more plastic fish dispersed throughout), and a second plastic layer. In one exemplary embodiment, the fluid layer may be colored, and may be semi-transparent.

Figure 2B:
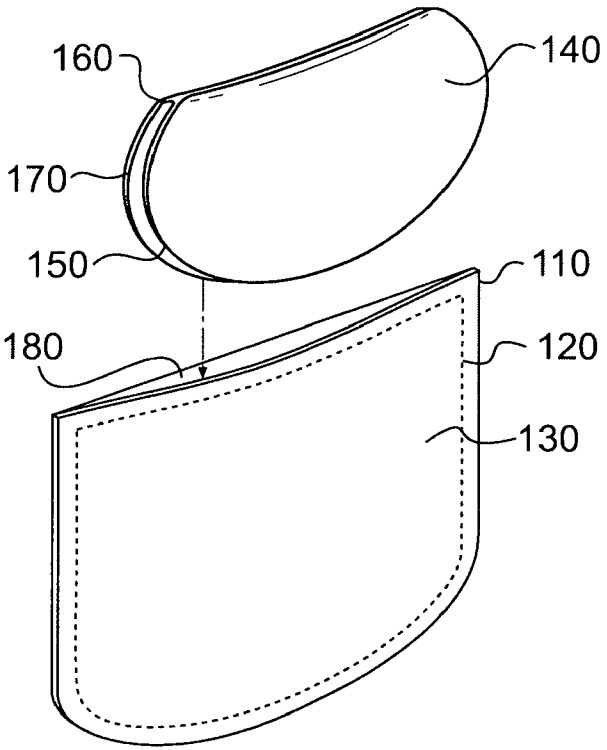
FIG. 2*b* is a perspective view of a pocket having an attachable and detachable cover, consistent with certain disclosed embodiments.
Figure 2A:
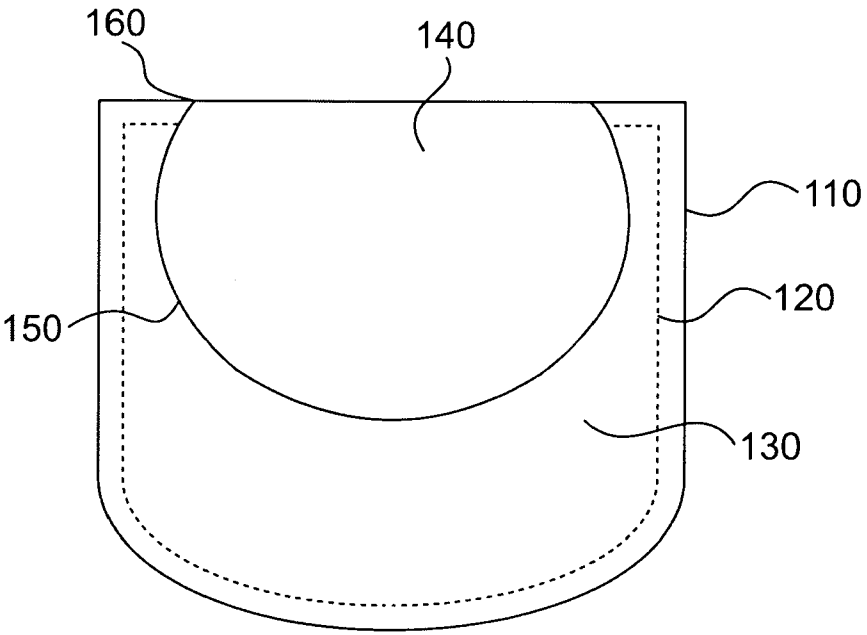
FIG. 2*a* is a front view of a pocket having an attachable and detachable cover, consistent with certain disclosed embodiments.

FIG. 2*a* illustrates a front view of pocket 110 having an attachable and detachable cover 140, and FIG. 2*b* illustrates a perspective view of pocket 110 and cover 140. FIGS. 2*a* and 2*b* illustrate that the shape of cover 140 may be rounded or oval-shaped. In other embodiments, the shape of cover 140 may be any shape or combination of shapes such as, for example, rhomboid, rectangular, square, circle, oval, irregular, etc. In a manner similar to that discussed above in connection with FIGS. 1*a* and 1*b*, interior portion 170 of cover 140 may be inserted into inner area 180 of pocket 110, and may have the same general shape as exterior portion 150 or a different shape.

Figure 3B:
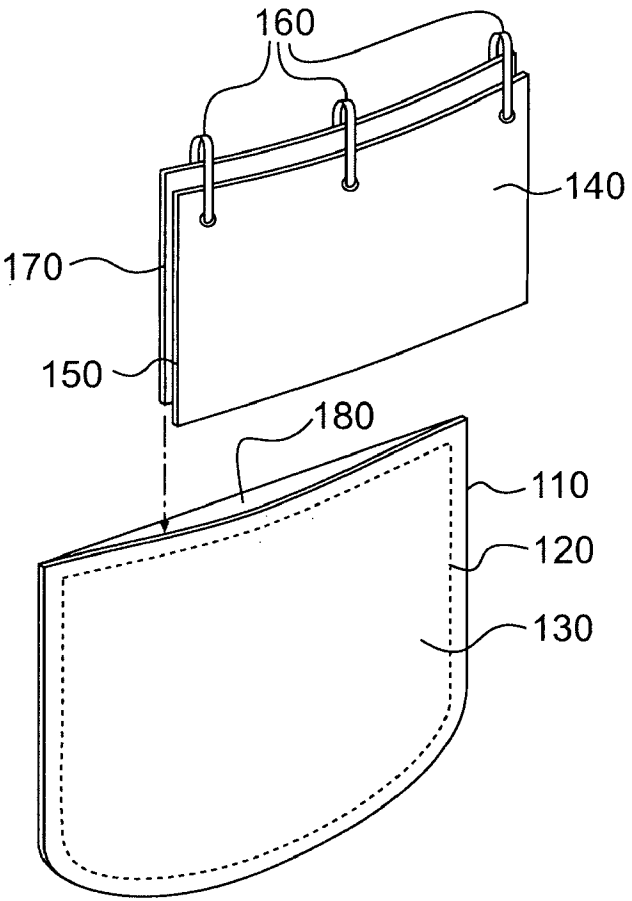
FIG. 3*b* is a perspective view of a pocket having an attachable and detachable cover, consistent with certain disclosed embodiments.
Figure 3A:
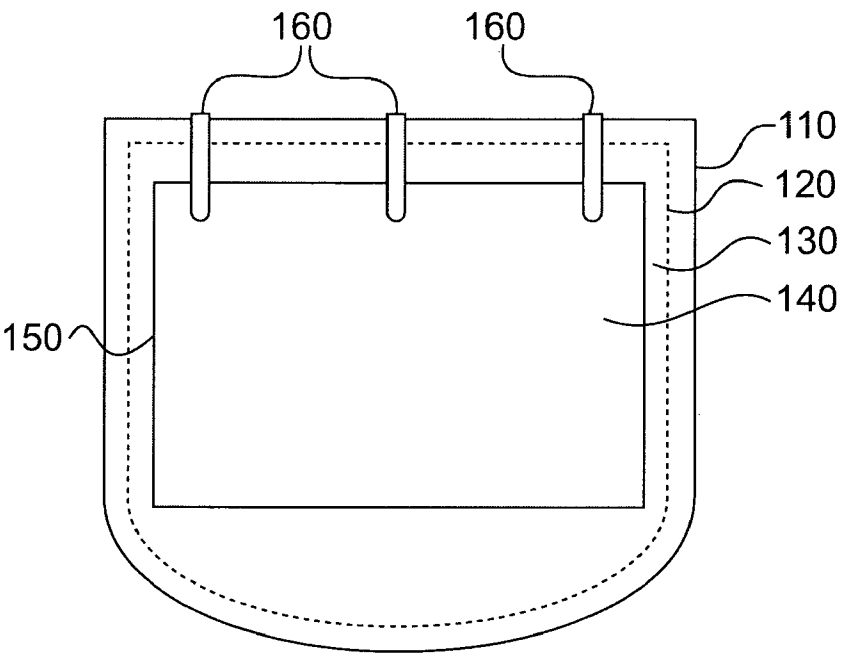
FIG. 3*a* is a front view of a pocket having an attachable and detachable cover, consistent with certain disclosed embodiments.

FIG. 3*a* illustrates a front view of pocket 110 having an attachable and detachable cover 140, and FIG. 3*b* illustrates a perspective view of pocket 110 and cover 140. As shown in FIGS. 3*a* and 3*b*, cover 140 may include exterior portion 150, bridging portion 160, and interior portion 170. As discussed above in connection with FIGS. 1*a* and 1*b*, exterior portion 150, bridging portion 160, and interior portion 170 may each include one or more layers of material. In this embodiment, bridging portion 160 may be configured to provide a connection between exterior portion 150 and interior portion 170 by one or more bridging portions 160. For example, bridging portions 160 may include one or more pieces of material, such as, for example, backing materials, facing materials, finishing materials, embellishment materials, connection mechanisms, etc. Bridging portions 160 may be of any shape or size. In addition, bridging portions 160 may be rigid, flexible, or any combination or variation thereof.

In a manner similar to that discussed above in connection with FIGS. 1*a* and 1*b*, interior portion 170 of cover 140 may be inserted into an inner area 180 of pocket 110. Thus, as shown in FIGS. 3*a* and 3*b*, bridging portion 160 may be integrated into the decorative features of cover 140. In addition, bridging portion 160 may be external to the one or more layers of interior portion 170 and/or exterior portion 150, may be internal to the one or more layers of interior portion 170 and/or exterior portion 150, or any combination thereof.

Figure 4B:
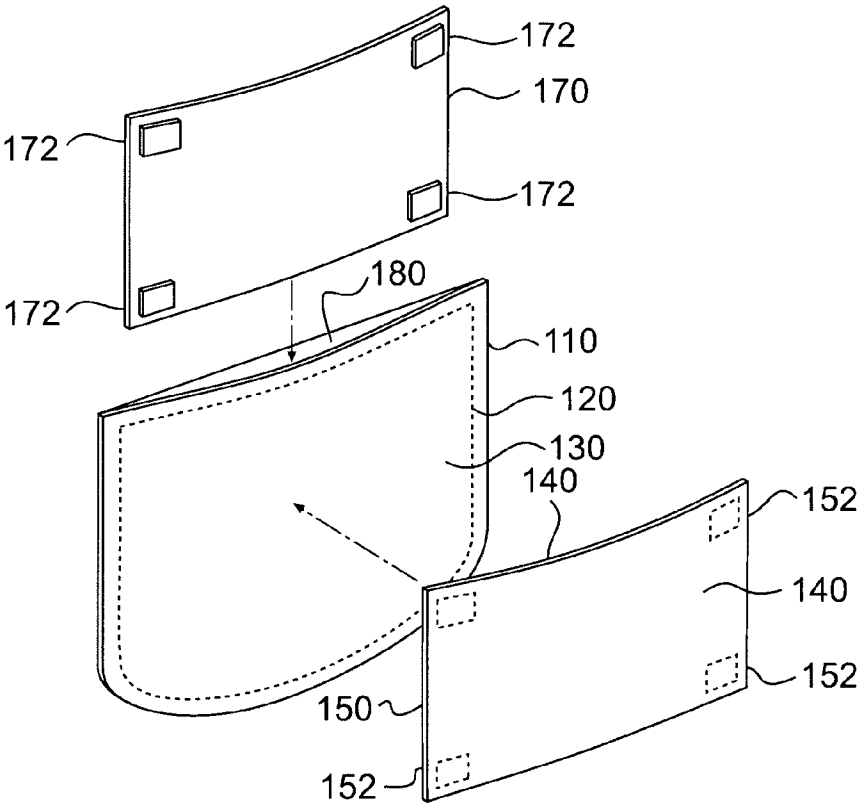
FIG. 4*b* is a perspective view of a pocket having an attachable and detachable cover, consistent with certain disclosed embodiments.
Figure 4A:
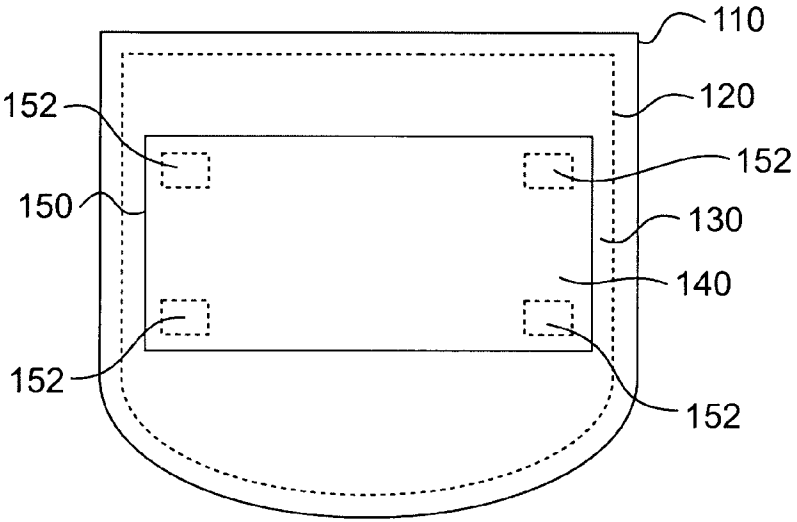
FIG. 4*a* is a front view of a pocket having an attachable and detachable cover, consistent with certain disclosed embodiments.

FIG. 4*a* illustrates a front view of pocket 110 having an attachable and detachable cover 140, and FIG. 4*b* illustrates a perspective view of pocket 110 and cover 140. As shown in FIGS. 4*a* and 4*b*, cover 140 may include exterior portion 150 and interior portion 170. As discussed above in connection with FIGS. 1*a* and 1*b*, exterior portion 150 and interior portion 170 may each include one or more layers of material. In a manner similar to that discussed above in connection with FIGS. 1*a* and 1*b*, interior portion 170 may be inserted into inner area 180 of pocket 110. In this embodiment, interior portion 170 may be configured to retain exterior portion 150 in proximity with pocket face 130. For example, one or more layers of interior portion 170 may include one or more magnets or metallic materials 172, while one or more layers of exterior portion 150 may also include one or more corresponding magnets or metallic materials 152. Magnets or metallic materials 152 and 172 may be configured in such a manner as to cause exterior portion 150 to be drawn closer to interior portion 170. In one exemplary embodiment, magnets or metallic materials 152 and 172 may be external to a surface of exterior portion 150 and interior portion 170, respectively. In another exemplary embodiment, magnets or metallic materials 152 and 172 may be internal to a surface of exterior portion 150 and interior portion 170, respectively. That is, one or more other layers of material may extend over magnets or metallic materials 152 and 172. In yet another exemplary embodiment, instead of magnets or metallic materials, other items, such as snaps, may be used.

In addition, as discussed above in connection with FIGS. 1*a* and 1*b*, both exterior portion 150 and interior portion 170 may be reversible. That is, exterior portion 150 may be turned over, exterior portion 150 may be inserted into an inner area 180 of pocket 110, an externally-positioned interior portion 170 may be turned over, or any combination thereof.

Figure 5B:
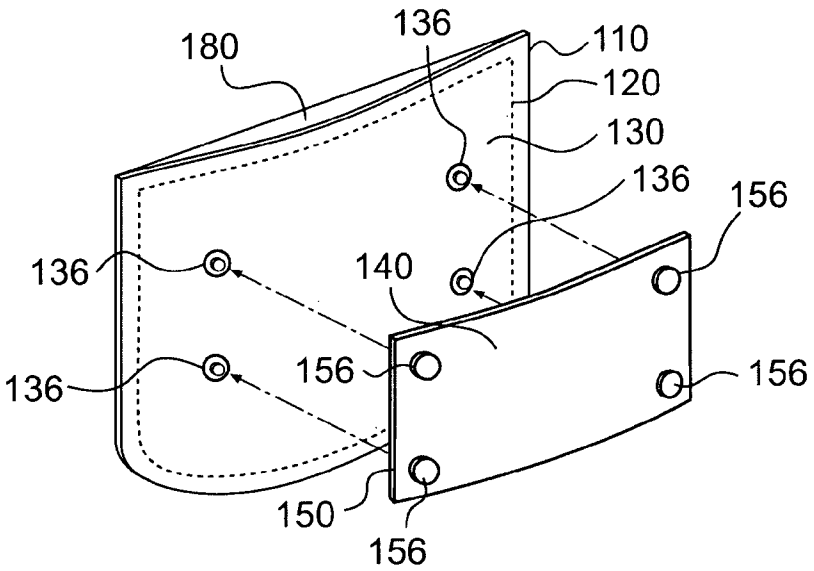
FIG. 5*b* is a perspective view of a pocket having an attachable and detachable cover, consistent with certain disclosed embodiments.
Figure 5A:
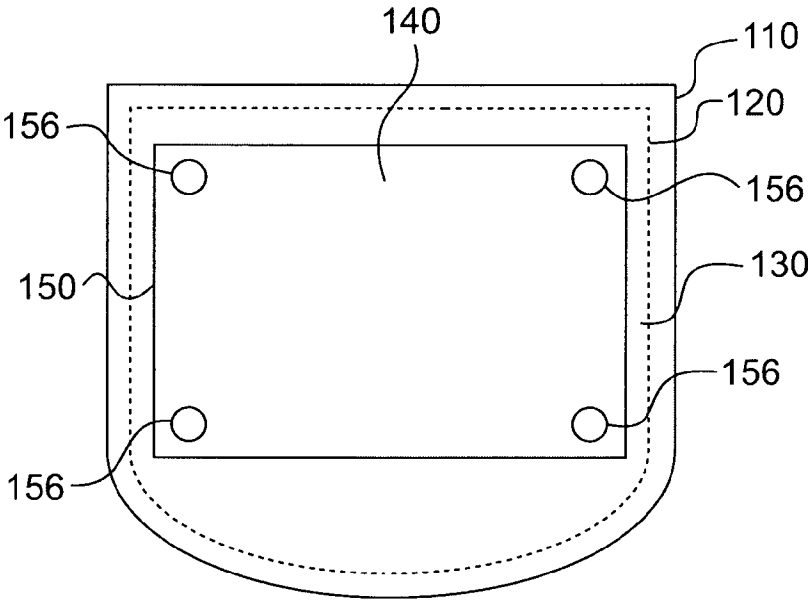
FIG. 5*a* is a front view of a pocket having an attachable and detachable cover, consistent with certain disclosed embodiments.
Figure 5C:
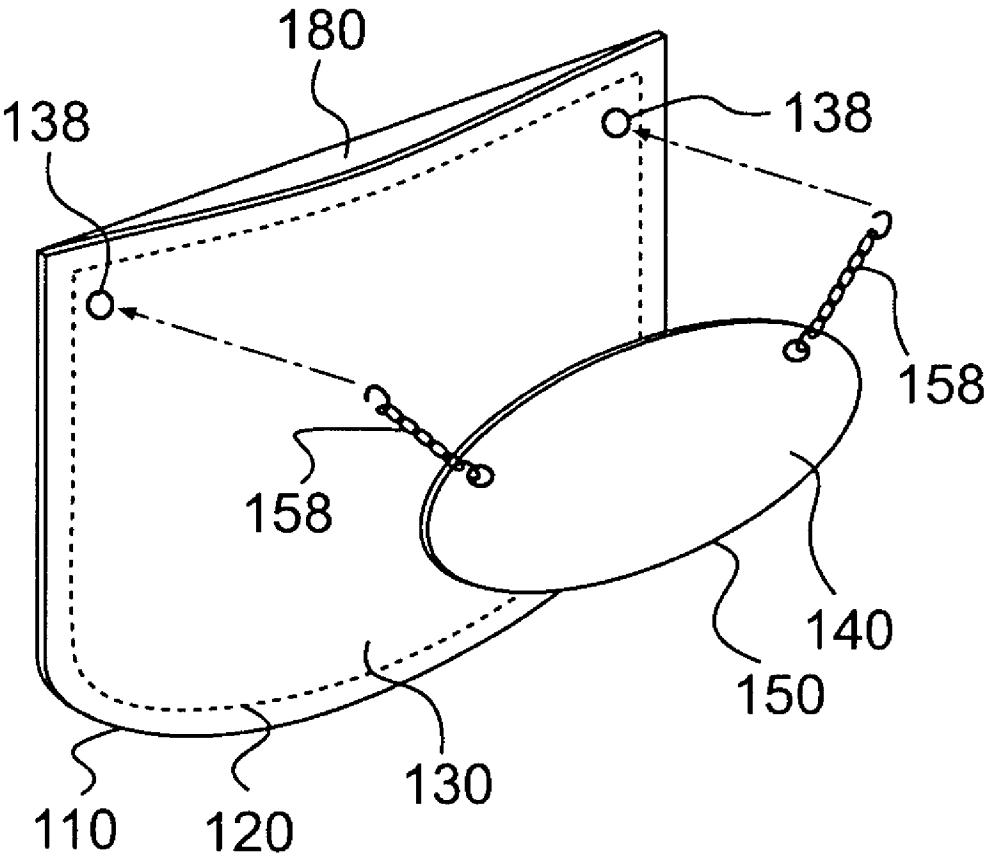
FIG. 5*c* is a perspective view of a pocket having an attachable and detachable cover, consistent with certain disclosed embodiments.

FIG. 5*a* illustrates a front view of pocket 110 having an attachable and detachable cover 140. FIGS. 5*b* and 5*c* each illustrate a perspective view of pocket 110 having an attachable and detachable cover 140. As shown in FIGS. 5*a*, 5*b*, and 5*c*, cover 140 may include only exterior portion 150. As discussed above in connection with FIGS. 1*a* and 1*b*, cover 140 may include one or more layers of material and may be any shape, size, or configuration. In addition, cover 140 may include one or more mechanisms for detachably retaining cover 140 in proximity to pocket face 130.

In one exemplary embodiment, the one or more mechanisms may include one or more built-in features or elements. For example, as shown in FIG. 5*a*, exterior portion 150 of cover 140 may include one or more button holes through which one or more buttons 154 may be inserted and used to retain cover 140 in proximity with pocket face 130. As another example, as shown in FIG. 5*b*, exterior portion 150 of cover 140 may include one or more receiving snap pieces 156 into which one or more corresponding protruding snap pieces 136 may be inserted. The one or more receiving snap pieces 156 and corresponding protruding snap pieces 136 may be used to retain cover 140 in proximity with pocket face 130. As an additional example, as shown in FIG. 5*c*, exterior portion 150 of cover 140 may include one or more connection mechanisms 158 (e.g., hooks, clasps, etc.) that may be used in connection with one or more corresponding connection mechanisms 138 (e.g., grommet, eyelet, etc.) on pocket 110 to retain cover 140 in proximity with pocket face 130. Thus, as shown in FIGS. 5*a*, 5*b*, and 5*c*, the mechanism by which cover 140 remains in proximity with pocket face 130 may be integrated into the decorative features of cover 140. In addition, connection between cover 140 and pocket 110 may be internal to exterior portion 150, internal to exterior portion 150, or any combination thereof.

In addition, one or more receiving mechanisms may be external to pocket face 130. The one or more receiving mechanisms may be permanent (i.e., built-in) or detachably removable. For example, a layer of hook-and-loop tape may be attached to pocket face 130, and a corresponding layer of hook-and-loop tape may be located on the reverse face (i.e., the face in proximity to pocket face 130) of exterior portion 150. As another example, a layer of magnetized and/or metallic material may be attached to pocket face 130, and a corresponding magnetized and/or metallic cover 140 may be located internally to the exterior portion 150 or on the reverse face (i.e., the face in proximity to pocket face 130) of exterior portion 150. Attachment to pocket face 130 may be permanent or temporary. For example, a layer of hook-and-loop tape may be attached to the pocket permanently by an adhesive and/or stitching. Alternatively, the layer of hook-and-loop tape may be attached temporarily via any of the mechanisms discussed herein. That is, the layer of hook-and-loop tape may be a top-most layer of the exterior portion 150 of cover 140.

Figure 6B:
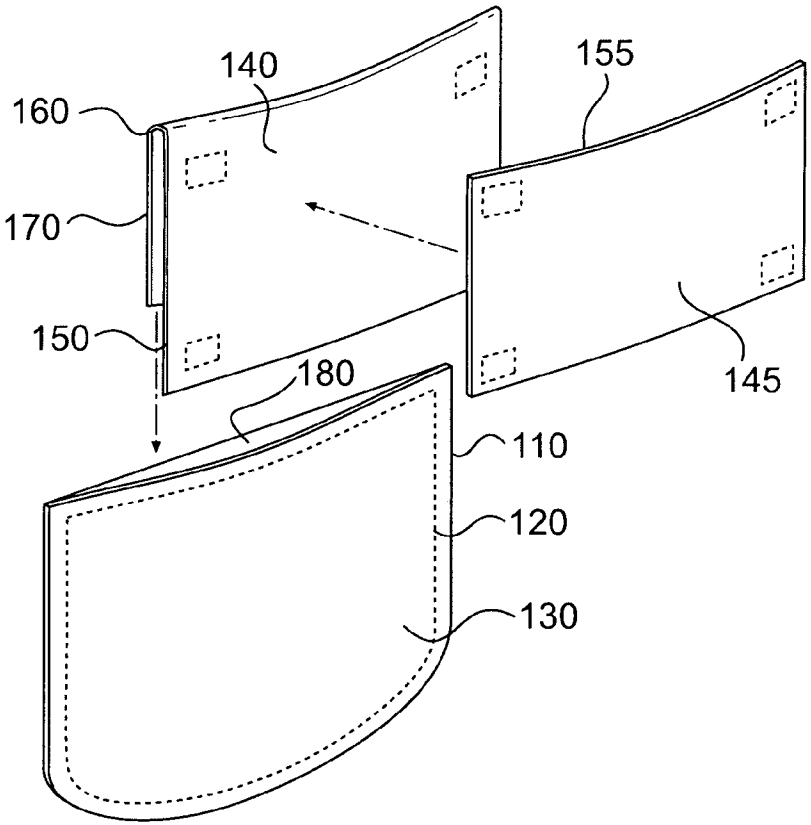
FIG. 6*b* is a front view of a pocket having an attachable and detachable cover, consistent with certain disclosed embodiments.
Figure 6A:
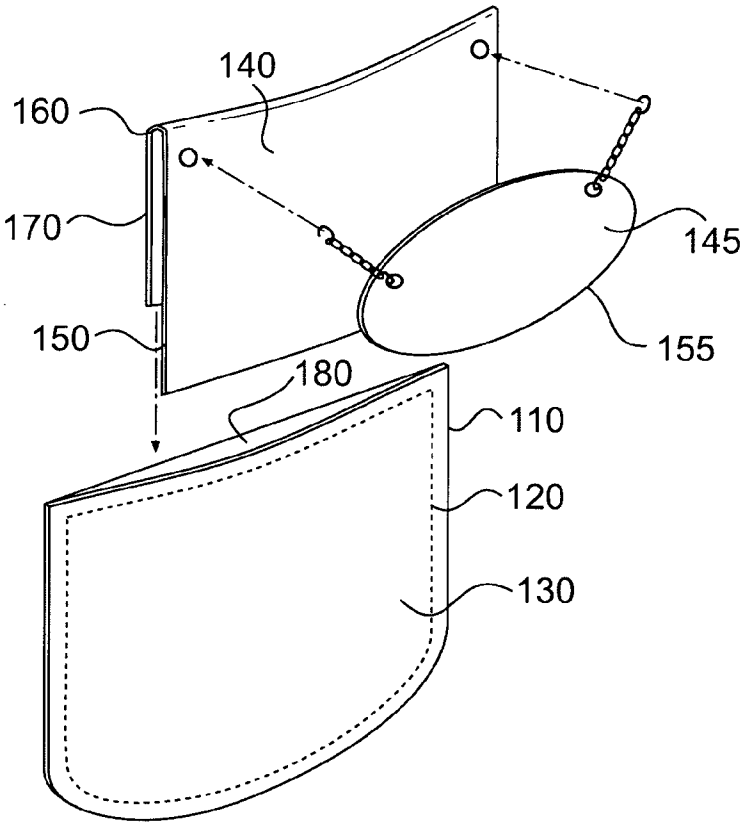
FIG. 6*a* is a front view of a pocket having an attachable and detachable cover, consistent with certain disclosed embodiments.

In another embodiment, as shown in FIG. 6*a*, one or more receiving mechanisms may be attached to exterior portion 150 of cover 140. For example, one or more receiving grommets may be attached to exterior portion 150 and one or more corresponding hooks may be used to attach attaching portion 155 to the exterior portion 150 of cover 140. In another exemplary embodiment, as shown in FIG. 6*b*, one or more receiving magnets and/or magnetic materials may be attached to exterior portion 150 and one or more corresponding magnets and/or magnetic materials may be used to attach attaching portion 155 to the exterior portion 150 of cover 140. Attaching portion 155 may include any one or more backing materials, facing materials, finishing materials, embellishment materials, connection mechanisms, etc. In addition, the one or more receiving and corresponding attachment elements (e.g., grommets, snaps, hooks, buttons, magnets, hook and loop tape, etc.) may include decorative features and or elements. For example, the corresponding hooks may include charms that may be attached to exterior portion 155 via one or more receiving grommets.

Figure 8:
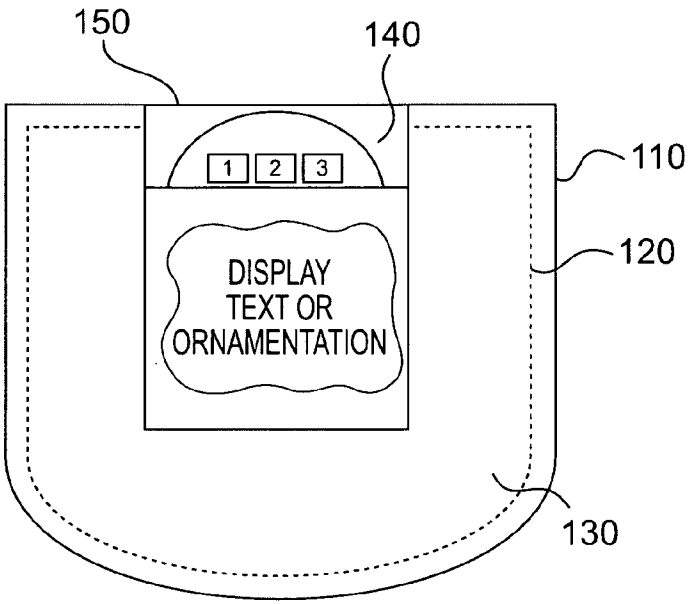
FIG. 8 is a front view of a pocket having an attachable and detachable cover, consistent with certain disclosed embodiments.
Figure 7:
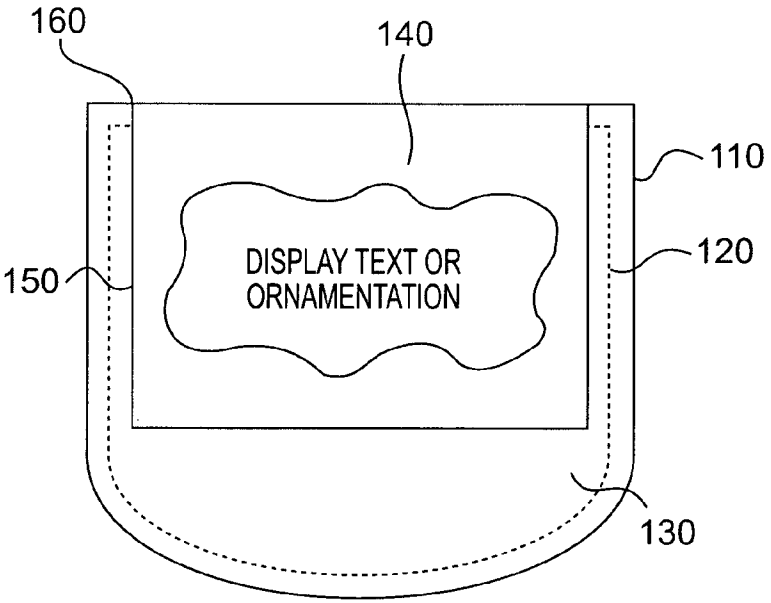
FIG. 7 is a front view of a pocket having an attachable and detachable cover, consistent with certain disclosed embodiments.

The disclosed embodiments may be implemented with any type of pocket. The disclosed embodiments may achieve improved ability to accessorize pockets, using attachable and detachable covers and decorative pocket features. In particular, the disclosed embodiments may allow a wearer to selectively and interchangeably display advertising or other communication on the pocket cover or allow the pocket cover to function as a decorative carrier. As shown in FIG. 7, the disclosed embodiments may, for example, allow a wearer to display personal ornamentation, accessorize a garment or ensemble, personalize a bag or purse, etc. For example, one or more layers of pocket cover 140 may include writing using paints, threads, cloth materials, etc., as discussed in greater detail above. Further, as shown in FIG. 8, the disclosed embodiments may function as a carrier for other items, such as, for example, audio and/or video devices, cosmetic and/or perfumery, or other personal articles. In FIG. 8, for example, pocket cover 140 may carry a cell phone, and may include one or more decorative elements, as described in greater details above.

In addition, the disclosed embodiments may be provided as a kit. For example, one or more of the materials disclosed herein may be provided along with instructions to enable the creation of decorative pocket covers as described. In addition to pockets, the disclosed embodiments may be useable with other garment components or features. For example, the disclosed embodiments may be utilized on sleeves, pants, breast and/or back sections of a garment, etc. As another example, the disclosed embodiments may be used at other points of a garment, such as, a waistband, a neckline, a sleeve cuff, etc.

It will be apparent to those skilled in the art that various modifications and variations can be made in the attachable and detachable pocket covers. It is intended that the specification and examples be considered as exemplary only, with a true scope of the disclosed embodiments being indicated by the following claims and their equivalents.

What is claimed is:

1. An attachable and detachable cover for a pocket having an inner area, the cover comprising:

a first portion configured to be disposed external to the pocket, wherein the first portion is shaped to generally conform to a contour of the pocket, and is removably securable to the pocket, the first portion including a decorative element;

a second portion configured to be disposed within the inner area of the pocket, wherein the second portion is configured to retain the cover on the pocket; and a third portion configured to connect the first portion and the second portion, wherein the first portion includes one or more first connecting mechanisms by which a fourth portion is configured to be connectable to the first portion.

2. The cover of claim 1, wherein the decorative element includes a message.

3. The cover of claim 1, wherein the first portion includes a first face and a second face, and a direction of the first face relative to the pocket and a direction of the second face relative to the pocket are reversible.

4. The cover of claim 1, wherein the third portion bridges a top of the pocket.

5. The cover of claim 1, wherein the third portion extends a width of each of the first portion and the second portion.

6. The cover of claim 1, wherein the third portion extends less than a width of each of the first portion and the second portion.

7. The cover of claim 1, wherein the first portion includes a plurality of first layers of material and the second portion includes a plurality of second layers of material.

8. The cover of claim 7, wherein the plurality of second layers includes at least two types of material.

9. The cover of claim 7, wherein at least one of the plurality of second layers of material causes the first portion to retain a position proximally disposed to an external surface of the pocket using one or more magnetic elements.

10. The cover of claim 7, wherein at least one of the plurality of second layers includes at least one of an adhesive layer, an embellishment, and a fabric.

11. The cover of claim 7, wherein at least one of the plurality of first layers includes at least one of an adhesive layer, an embellishment, and a fabric.

12. The cover of claim 1, wherein the fourth portion includes one or more second connecting mechanisms by which the fourth portion is connected to the first portion.

13. The cover of claim 12, wherein the one or more second connecting mechanisms includes at least one of a magnetic element, a metallic element, one or more first snap components, and one or more first hook-and-loop tape segments.

14. The cover of claim 1, wherein the one or more first connecting mechanisms includes at least one of a magnetic element, a metallic element, one or more first snap components, and one or more first hook-and-loop tape segments.

15. An attachable and detachable cover for a pocket having an inner area, the cover comprising:

a first portion configured to be disposed external to the pocket, wherein the first portion is shaped to generally conform to a contour of the pocket, and is removably securable to the pocket, the first portion including one or more first layers of material; and a second portion configured to be disposable within the inner area, the second portion including one or more second layers of flexible material, wherein at least one layer of the one or more second layers is configured to retain a position of the first portion disposed proximally to an external surface of the pocket, and wherein the first portion includes a first face and a second face, and a direction of the first face relative to the pocket and a direction of the second face relative to the pocket are reversible.

16. The cover of claim 15, wherein the at least one layer causes the first portion to retain a position proximally disposed to an external surface of the pocket using one or more magnetic elements.

17. The cover of claim 15, wherein at least one of the one or more second layers includes at least one of an adhesive layer, an embellishment, and a fabric.

18. The cover of claim 15, wherein at least one of the one or more first layers includes at least one of an adhesive layer, an embellishment, and a fabric.

19. An attachable and detachable cover for a pocket, the pocket having an inner area, the cover comprising:

a first portion disposable external to the pocket, wherein the first portion is shaped to generally conform to a contour of the pocket, and is removably securable to the pocket, the first portion including an advertisement;

a second portion disposable within the inner area of the pocket, the second portion configured to retain the cover on the pocket, wherein the first portion and the second portion are reversible such that the first portion is disposable within the inner area of the pocket and the second portion is disposable external to the pocket; and a third portion connecting the first portion and the second portion, wherein the third portion is configured to bridge a top of the pocket.

20. A method for attaching and detaching a cover for a pocket having an inner area, the method comprising:

positioning a first portion of the cover external to the pocket such that the first portion generally conforms to a contour of the pocket;

retaining the cover on the pocket by disposing a second portion of the cover in the inner area of the pocket;

positioning, via a third portion of the cover bridging a top of the pocket, the first portion of the cover and the second portion of the cover; and connecting the first portion to a fourth portion via one or more connecting mechanisms.

21. A method for attaching and detaching a cover for a pocket having an inner area, the method comprising:

positioning a first portion of the cover external to the pocket such that first portion generally conforms to a contour of the pocket;

retaining the cover on the pocket by disposing a second portion of the cover in the inner area; and selecting one of a first face of the first portion or a second face of the first portion to dispose adjacent to the pocket based on a desired design.

* * * * *